United States Patent [19]

Koller et al.

[11] Patent Number: 4,486,261

[45] Date of Patent: Dec. 4, 1984

[54] APPARATUS FOR THE APPLICATION OF AN ADHESIVE TAPE ABOUT THE EDGE OF A SHAPED PART OF SHEET METAL

[75] Inventors: Hans Koller, Allschwil; Heinz Zingel, Beringen, both of Switzerland

[73] Assignee: Ciba-Geigy Corporation, Ardsley, N.Y.

[21] Appl. No.: 578,165

[22] Filed: Feb. 8, 1984

[30] Foreign Application Priority Data

Feb. 16, 1983 [CH] Switzerland ..... 86/83
Dec. 2, 1983 [CH] Switzerland ..... 6464/83

[51] Int. Cl.[3] ..... B61F 31/00

[52] U.S. Cl. ..... 156/461; 156/201; 156/202; 156/216; 156/463; 156/464; 156/468

[58] Field of Search ..... 156/443, 461, 463–468, 156/475, 486, 200–202, 204, 226–227, 216, 577

[56] References Cited

U.S. PATENT DOCUMENTS 4,155,798 5/1979 Becker ..... 156/461
4,401,503 8/1983 Hertel ..... 156/464

*Primary Examiner*—David Simmons

*Attorney, Agent, or Firm*—Harry Falber

[57] ABSTRACT

An apparatus for the application of an adhesive film strip about the edge of a shaped part of sheet metal comprises a pair of application roller which rolls on the adhesive tape about the metal sheet edge, imparting to the strip a U-shaped cross section. The adhesive film strip is originally on a carrier tape and is on a storage reel from which it is drawn off by conveying rollers. After being separated from the carrier tape, the adhesive film strip is fed via free-wheeling pre-folding rollers to a pair of application rollers, and the carrier tape is removed by means of further conveying rollers. The pair of application rollers and the pre-folding rollers can be swivelled together about an axis extending parallel with the shafts of the application rollers, and are at the same time resiliently displaceable in the direction of this axis. The distance of the application roller shafts from the said swivelling axis is adjustable in order to achieve a leading or a trailing run. The pre-folding rollers have a longitudinal section of concave or V-shaped configuration, and each is supported by itself additionally by means of soft springs, the application rollers can follow the metal sheet edge continuously, pressing the adhesive film strip against the said edge.

24 Claims, 13 Drawing Figures

APPARATUS FOR THE APPLICATION OF AN ADHESIVE TAPE ABOUT THE EDGE OF A SHAPED PART OF SHEET METAL

BACKGROUND OF THE INVENTION

This invention relates to an apparatus for the application of an adhesive tape, longitudinally and with U-shaped cross section, about the edge of a shaped part of sheet metal, which apparatus is provided with tape-guiding means, comprising conveying rollers, and means for pre-folding the adhesive tape from which the pre-folded tape runs between two application rollers spring-biassed against each other which are adapted to press the tape simultaneously on to both sides of a shaped sheet metal part which is introduced into the tape-folding zone.

In the sheet metal processing industry the pasting over of metal parts-connecting folded seams by means of pressure or heat-hardenable adhesives is widely used. Thus, it is customary, for instance, in the automobile industry to seal in this manner folded seams of certain automobile body parts, in particular doors, and thereby to avoid the danger of corrosion.

In the automobile industry and similar branches of industry, there are usually employed adhesives in liquid or pasty form for producing such pasted-over folded seam joints, which adhesives are applied to the sheet metal parts to be joined in the form of a cord. This method of applying adhesive is unsatisfactory in several respects. One such drawback is seen in the fact that the distribution of the adhesive, attained by this method, over the entire folded seam is not sufficiently uniform, which fact may cause problems of corrosion, and, as another drawback, the use of adhesives in liquid or pasty form always causes problems of work hygiene.

In the manufacture of cans for preserving food and the like, it is also conventional to paste over folded seams or seal them with adhesives, as described, for instance, in U.S. Pat. No. 3,125,056, French patent application Publication No. 2,252,147 or Belgian Pat. No. 444,014. The adhesive is applied in these cases to the crimped edges of the parts of the can body to be connected with one another, either in liquid or pasty form, by extrusion or the like, or in the form of a strip of adhesive tape.

Adhesives in the shape of foils or, in particular, of tapes such as they are known by the trade names Araldit ® and Redux ® Adhesive Foil (CIBA-GEIGY) are increasingly used, especially because of their advantages of greater work hygiene. However, in the past, such adhesive foils or tapes have only found very limited use, or no use at all, for sealing or pasting-over folded seams, e.g., of automobile body parts.

This is preponderantly due to the fact that these adhesive films are highly cohesively plastic (of high viscosity) and that their low tensile strength causes considerable difficulties in applying them by machine operations. Additional complications arise when such adhesive strips must be applied to parts of automobile bodies whose folded seams have a complicated configuration, in particular one that is curved tridimensionally. These difficulties are especially great when a crimped rim is to be provided with adhesive on both sides thereof, i.e. when the adhesive tape is to be laid about the rim with a U-shaped tape cross-section.

The hitherto known apparatus of the initially described type are only suitable for processing relatively stiff adhesive tapes of considerable tensile strength (not self-adhesive films). This is, for instance, true of an apparatus described in U.S. Pat. No. 4,155,798 which comprises a pre-folding channel and press-on rollers.

In recognition of the fact that the lack of suitability of the known apparatus for applying cohesively plastic adhesive tapes of low inherent rigidity and tensile strength to curved metal sheet edges is caused above all by the rigid arrangement of the pre-folding channel and of the press-on or application rollers, and moreover by the fact that the application rollers are free-wheeling rollers (U.S. Pat. No. 4,155,798), an arrangement has already been proposed (European Pat. No. 72,779) in which, firstly, the pair of application rollers is pivotable as a unit about a common axis which extends parallel with the roller axes and spacedly ahead of them relative to the direction of tape conveyance, approximately in the plane of symmetry of the pre-folding channel, and in which, secondly, the application rollers can be motor-driven via elastically twistable shafts.

This arrangement constitutes a tremendous improvement over the known state of the art; however, extensive tests, carried out in practice, have shown that the quality of application could still be decisively improved in particular at higher speeds of application.

OBJECTS AND SUMMARY OF THE INVENTION

It is therefore an object of the invention to provide an apparatus of the initially described type which affords applications of substantially improved quality, even at higher speeds of application, and in particular, such apparatus in which the possibilities of movements to be carried out by the pair of application rollersare modified, and the means for pre-folding the adhesive tape can participate in these possibilities of movements.

These objects are attained in accordance with the present invention, in an apparatus of the initially described type in which the pair of application rollers and the means for pre-folding the adhesive tape are adapted for being swivelled, against the restoring bias of a spring, about a common swivel axis extending parallel with the axes of the application rollers.

The pair of application rollers can be mounted adjustably about the said common swivel axis, and is preferably arranged behind the swivel axis relative to the direction of movement of the shaped sheet metal parts.

According to another feature of the invention the pair of application rollers and the means for pre-folding the adhesive tape can be shifted together rearwardly and parallel with the common swivel axis against the bias of a compression spring.

The pair of application rollers and the means for pre-folding the adhesive tape can be mounted in an adjustable carrier unit which is adjustably, transverse to said common swivel axis, and fixedly mounted on a rotatable structural part or support unit being rotatable about said common swivel axis. The means for pre-folding the adhesive tape are adapted to be displaced relative to the pair of application rollers in parallel with the axes of the rollers against the bias of a displacement cushioning spring. Moreover, the pair of application rollers and the pre-folding means can be suspended together for elastically swivelling about a tilting axis which is perpendicular to the plane defined by the axes of the pair of application rollers.

One of the two application rollers can be arranged to be swivelled about an axis which extends in parallel with the axis of rotation of that same roller, and can be supported to press with bias against the other application roller.

The two application rollers can each be driven by a separate driving motor having an adjustable constant torque. An electronic circuit can be provided for controlling the driving motors by means of which circuit the torque and the idling speed of the motors or, respectively, of the application rollers driven by them, can be adjusted.

The conveying rollers can be driven each by a separate driving motor which is controlled by the same electronic circuit, while the adhesive tape is conveyed via a control roller, which is preferably of convex double cone configuration, prior to reaching the pre-folding means, the said control roller being supported pivotably about an axis which is parallel with the axis of the control roller against the bias of a restoring spring, while the deflection of the control roller depends on the tractive force of the adhesive tape. The control roller is preferably coupled with an electric measuring transducer which, in cooperation with the electronic circuit, so controls the driving motor for the conveying rollers that the tensile stress in the adhesive tape remains constant.

The pair of application rollers and the pre-folding means can be mounted in a supporting block which is carried by a carriage or sled and is elastically movable in the direction of the common swivel axis. The sled can be mounted transversely adjustably on a guiding plate, serving as carrier element and being resiliently pivotable about the common swivel axis. The guiding plate can be supported for swivelling in a bracket part which is in turn mounted resiliently tiltable in a casing.

The supporting unit which is rotatable about the common swivel axis is preferably displaceable toward the rear in the direction of the common swivel axis against the bias of a compression spring. This rotatable structural unit can be a hollow body which can be rotated as well as swivelled and which is mounted for axial displacement against the force of a compression spring, whereby the common swivel axis constitutes the central axis of the hollow body.

The means for pre-folding the adhesive tape can be a roller of concave or V-shaped axial profile.

The conveying rollers can be rollers urged in pairs resiliently against one another, at least one roller of each pair being supported on swivel member adapted to be swung out, which swivel members can be opened for threading into them an adhesive/carrier tape or a base carrier tape, and which can be fixed in closed conveyance-activating position by means of spring biassed stopping means, preferably a stop lever.

A tape-guiding channel can be provided ahead of the conveying rollers, in the direction of tape movement, which channel has a cross sectional area of such configuration as to secure the tape against twisting,and which is so curved away from longitudinal direction that the tape can contact the rollers of the conveying roller train with always only one and the same carrier tape side.

One of the two application rollers is a free wheeling roller which is connected with a first electronic tacho-alternator whose output signal is used for controlling the driving motor of the other roller.

The last-mentioned driving motor is connected to a second tacho alternator, and the control of the last-mentioned driving motor is effected by means of an electronic circuit which produces a control signal for the last-mentioned motor by comparison of the output signals of the two tacho-generators.

BRIEF DESCRIPTION OF THE DRAWINGS

The invention will be explained more in detail with regard to two embodiments thereof illustrated in the accompanying drawings in which.

Figure 1:
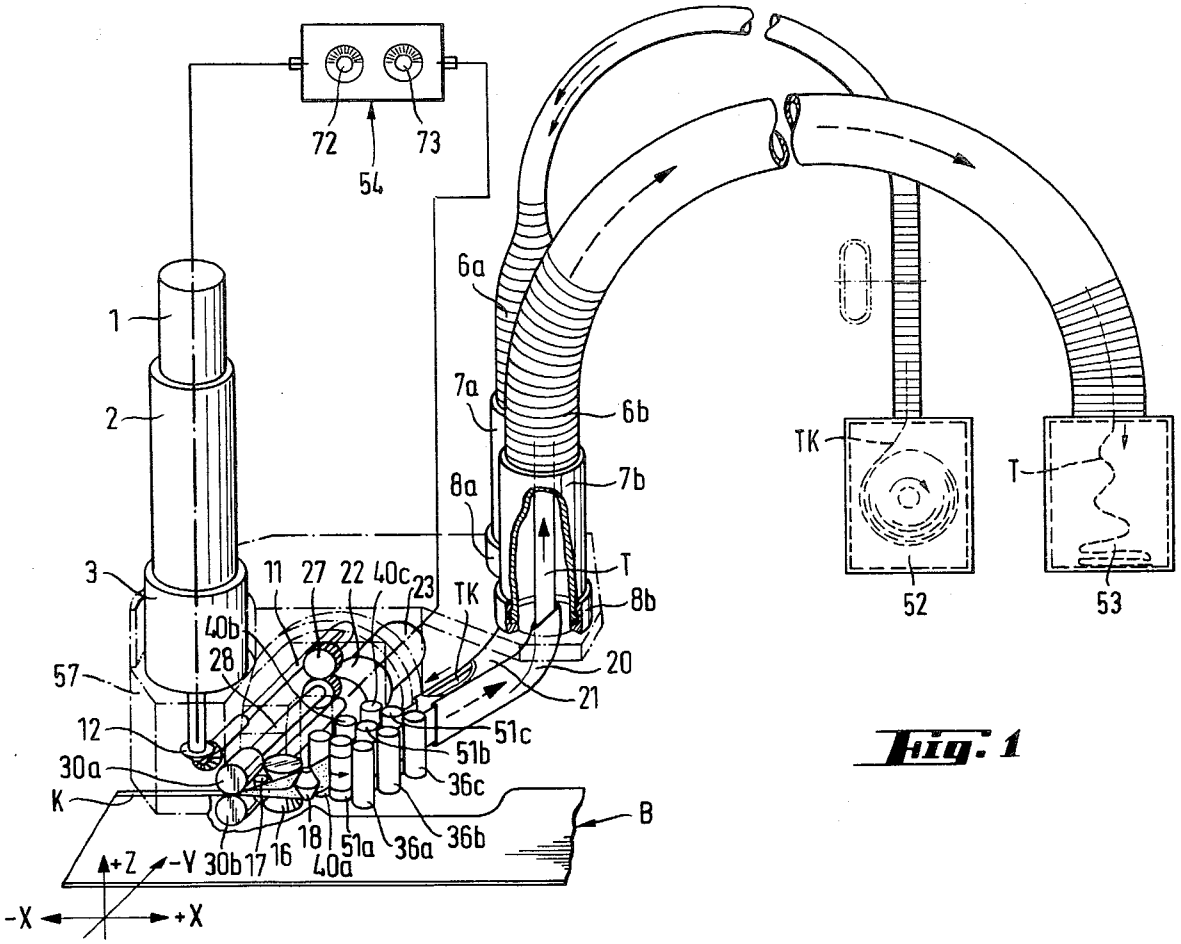
FIG. 1 is a schematic representation, in perspective view, of a first embodiment of the apparatus according to the invention.

DETAILED DESCRIPTION OF THE EMBODIMENTS SHOWN IN THE DRAWINGS.

As shown in FIG. 1, the application head proper of the first embodiment comprises a pair of press-on or application rollers 30*a*, 30*b*, driving means 1,2 and 3, conveying rollers 40*a* to 40*c*, 51*a* to 51*c* and 36*a* to 36*c*, pre-folding rollers 16 and 17, as well as guiding channels 21 and 20, respectively, for feeding of an adhesive film K borne on a carrier tape T and for leading off the carrier tape T after the adhesive film K has been removed therefrom.

The carrier tape T with the adhesive film K thereon referred to hereinafter briefly as the carrier-cum-adhesive TK-tape, travels from a storage reel 52(in a cassette) through a synthetic resin plastics hose 6*a* having an oval cross section, into the guiding channel 21. The carrier tape T is suctioned off through a further plastics hose 6*b* by means of a suctioning device 53. The two hoses 6*a* and 6*b* are connected to the application head by means of plug couplings 7*a*, 8*a* and 7*b*/8*b*, respectively.The curves of the guiding channels 21 and of the hose 6*a* through which the TK-tape is pulled by means of the conveying rollers 40*a* to 40*c* and 51*a* to 51*c*, are so designed with regard to the pull on the tape that the TK-tape will essentially only slide on the curved walls with its non-adhesive carrier tape side. The curved walls are thus essentially convex with regard to the carrier tape side. Due to the oval cross section of the hose 6a the TK-tape cannot become subject to torsion in the hose.

The application head is mounted on a moving device (not shown), for instance a robot of known construction, which will then be programmed in such a way that the pair of application rollers 30a,30b will pass along the edge of a sheet metal part B along both sides thereof and, in doing so, will apply the adhesive film in a configuration of V-shaped cross section on to the sheet metal edge.

The storage reel 52 and the suctioning device 53 are preferably mounted stationary, and the same applies to the enery supply and the control box 54 for the driving means 1, 2 and 3 of the diverse rollers 30a,30b,40a to 40c, 51a to 51c, 36a to 36c etc. of the application head. The lengths of the hoses 6a, 6b and the electric cables 4 and 5 for the energy supply and for the control of the driving means 1,2 and 3 are adapted selectively to the prevailing conditions.

Figure 2:
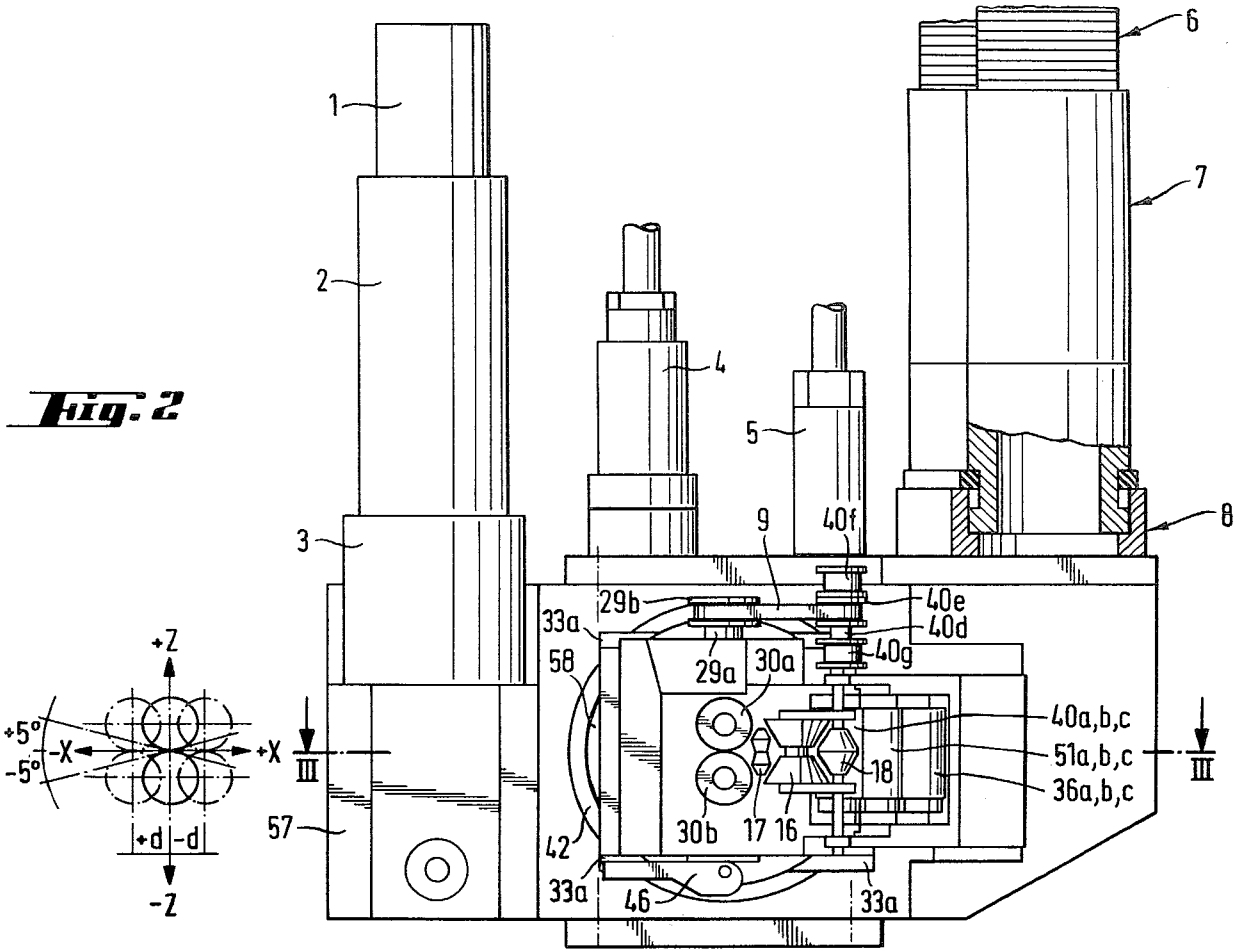
FIG. 2 is a frontal view of the application head proper of the embodiment shown in FIG. 1.
Figure 3:
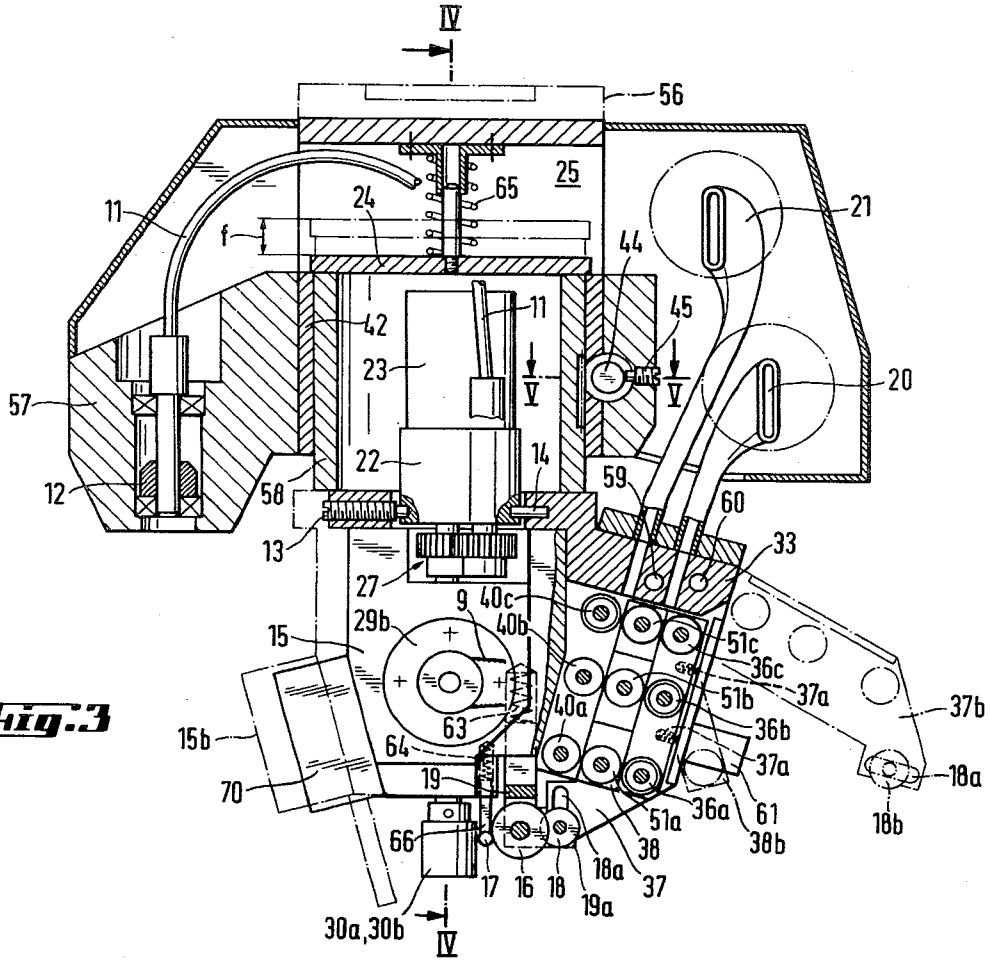
FIG. 3 is a longitudinal sectional view of the first embodiment shown in FIGS. 1 and 2, taken in a horizontal plane indicated by III—III in FIG. 2.
Figure 7:
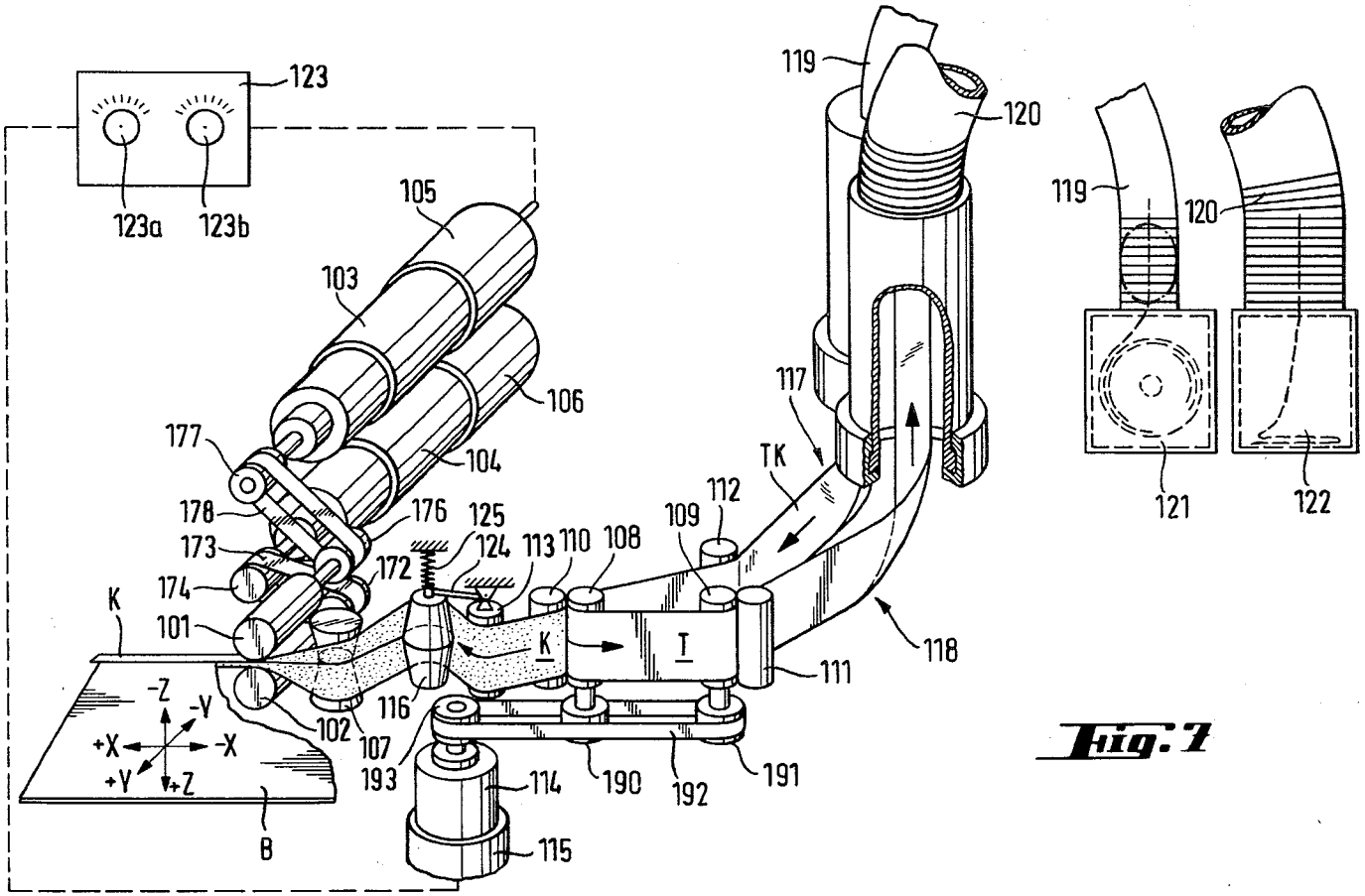
FIG. 7 is a perspective view showing schematically the essential parts of a second, preferred embodiment of the apparatus according to the invention.
Figure 9:
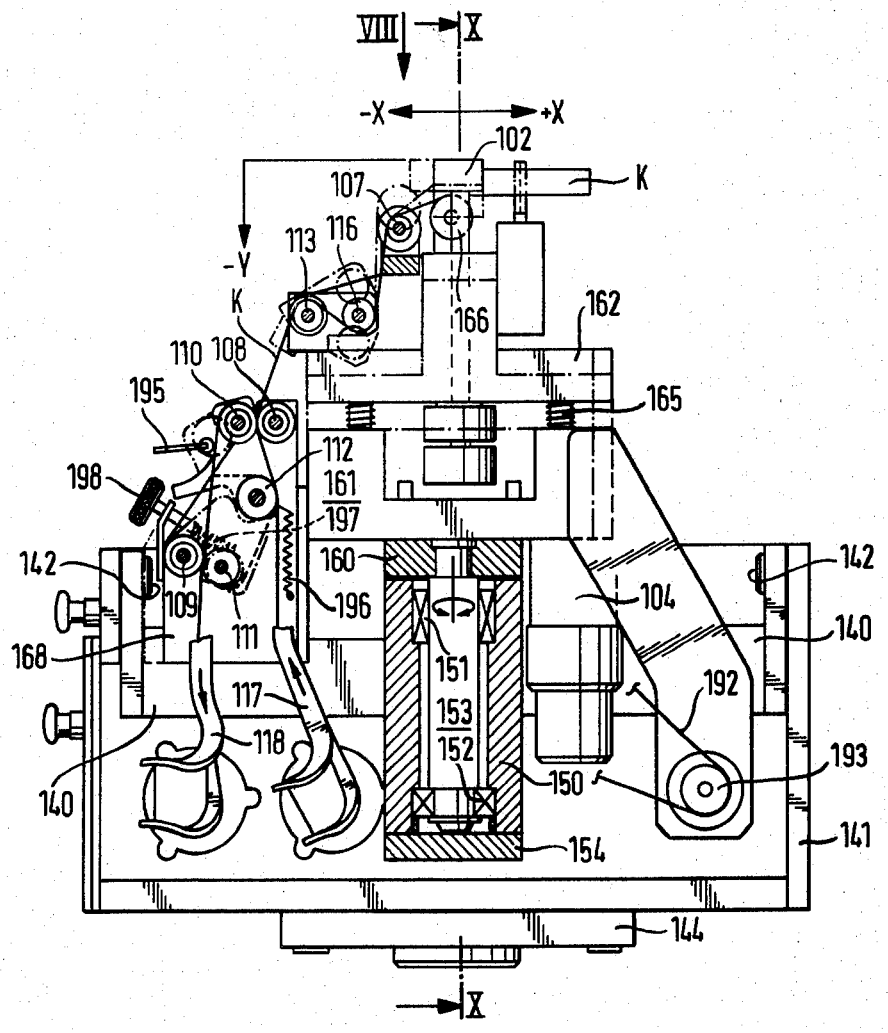
FIG. 9 is a top view, partially in section, of the second embodiment shown in FIG. 7, taken on to a plane indicated by IX—IX in FIG. 8.
Figure 10:
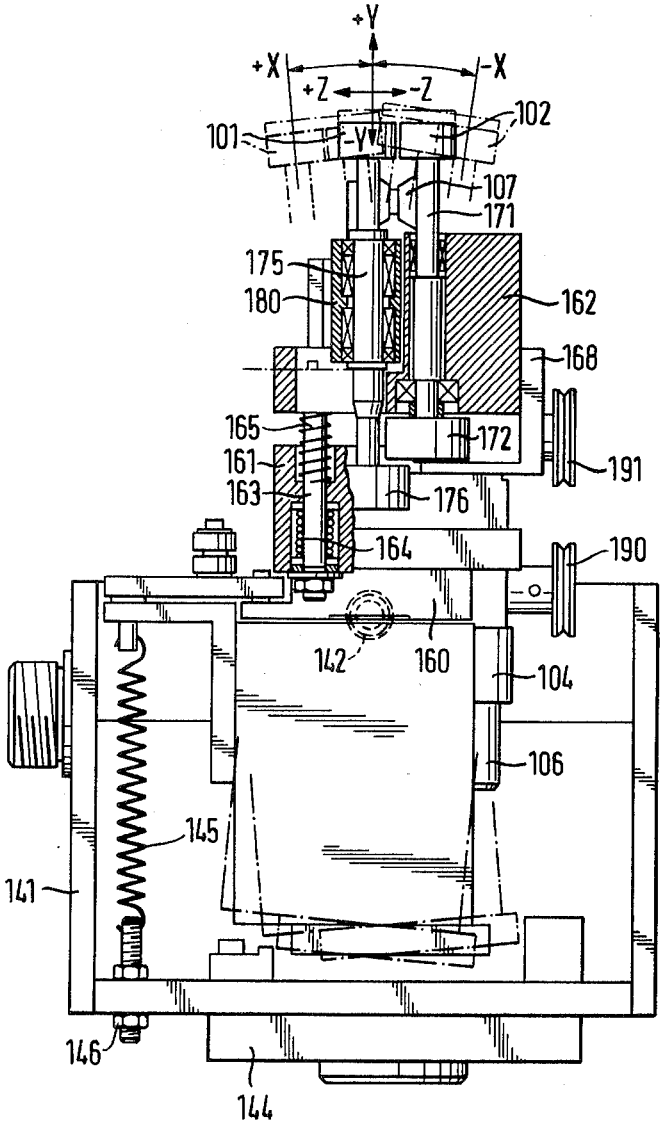
FIG. 10 is a longitudinal, partially sectional view of the second embodiment taken in a plane indicated by X—X in FIG. 9.

In each of the FIGS. 1,2 and 3 as well as in FIGS. 7,9 and 10 there is shown a coordinate system X-Y-Z which serves to simplify the description of the possibilities of movement of the different parts of the apparatus.

Figure 4:
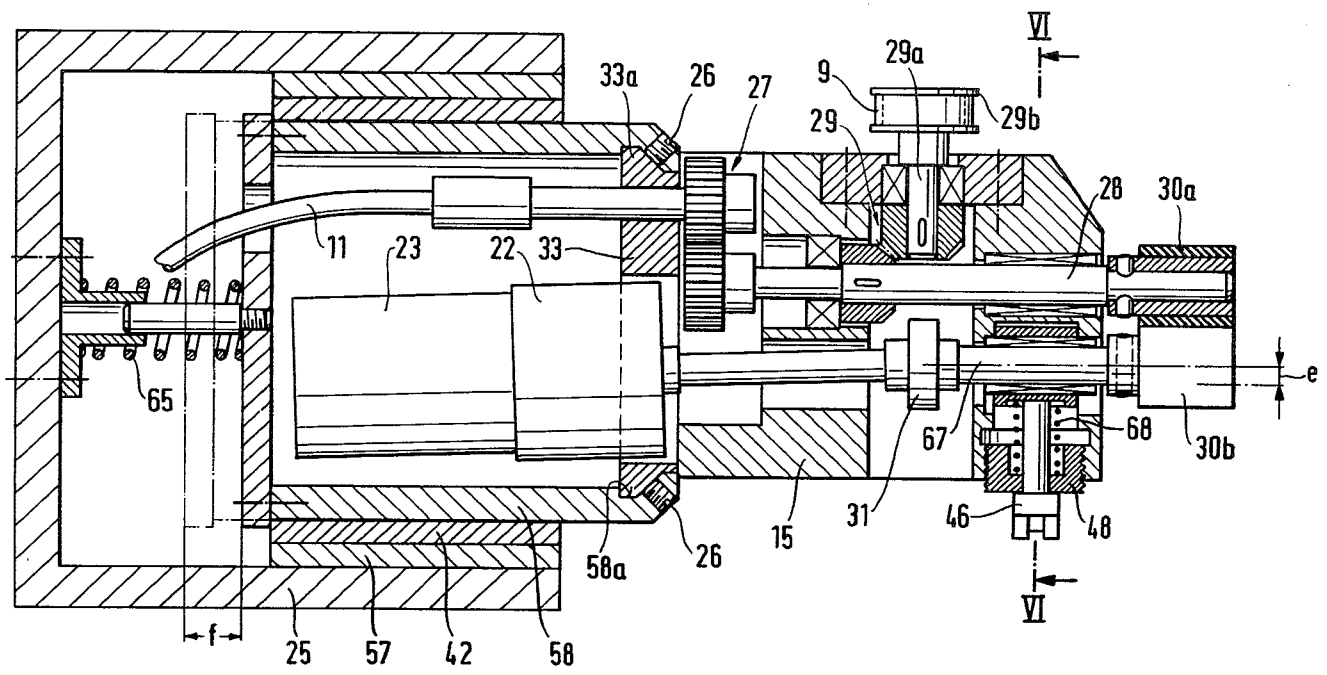
FIG. 4 is a longitudinal, partially sectional view of the first embodiment, but taken in a plane indicated by IV—IV in FIG. 3 and extending perpendicular to the plane III—III in FIG. 2.

As can best be seen from FIGS. 2,3 and 4, the application head can be mounted via its casing part 57 on the moving device (not shown), e.g. a robot, by means of a bracket part 25 or by means of a connecting flange 56. A cylinder 58 is supported by means of a bearing 42 in the casing part 57 so as to be rotatable about its shaft and axially displaceable along the latter. The application rollers 30a,30b or their respective shafts 28 and 67 are supported in a carrier unit 15 which, in turn, is supported for diametral displacement at the forward end of the rotatable and displaceable cylinder 58 by means of a dovetail guide 58a/33a or a similar guide means, and can be fixed in position by means of setting screws 26. A further wall part designated by 33 is firmly connected with the carrier unit 15 and bears the conveying rollers 36a to 36c, 40a to 40c and 51a to 51c and a counter-pressure roller 19, cooperating with the pre-folding roller 16, as well as the tape-guiding channels 20 and 21.

Figure 5:
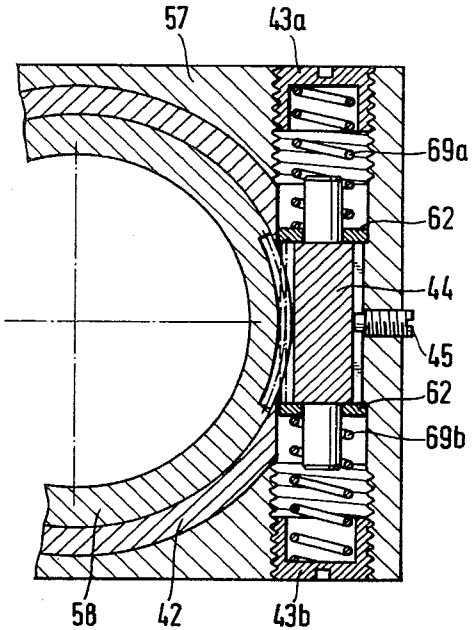
FIG. 5 is a cross sectional view of a portion of the first embodiment taken in a plane indicated by V—V in FIG. 3.

The cylinder 58 is displaceable rearwardly, against the bias of a spring 65, by a distance f (direction −Y) limited by stops (FIG. 3). Its maximal twisting angle and its "zero position" are determined by the mechanism illustrated in FIG. 5. This mechanism comprises a gear rack 44 and two counter-acting springs 69a and 69b whose spring tension can be adjusted by means of setting screws 43a and 43b, respectively. A guiding and setting screw for the rack 44 is designated by 45. Two discs 62 are provided to limit the spring action. In "zero" position the shafts of the application rollers 30a,30b are located approximately in the Y-Z plane.

Figure 6:
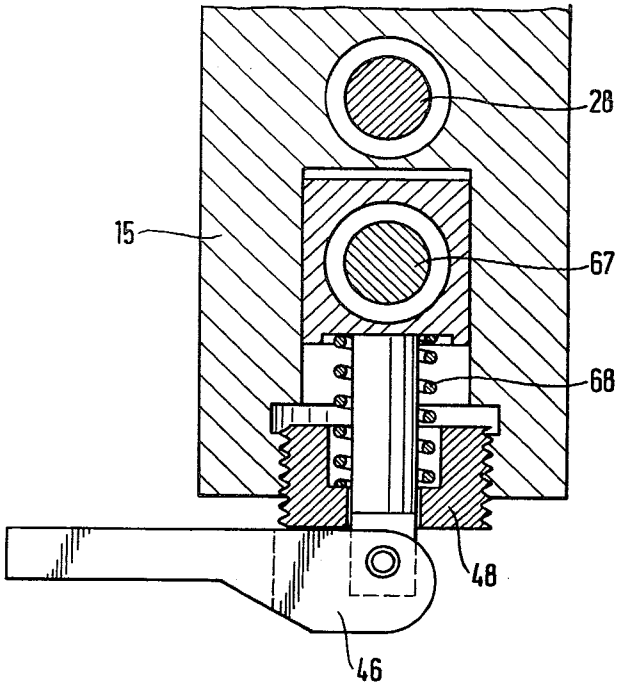
FIG. 6 is an enlarged cross sectional view of another portion of the first embodiment, taken in a plane indicated by VI—VI in FIG. 4.

As shown in FIGS. 1,4 and 6, the shaft 67 of the lower roller 30b of the pair of application rollers 30a, 30b is supported in a bearing part 47 which is borne, in turn, in the carrier unit 15 to be displaceable in Z-direction, and is biassed by means of a spring 68 in the direction +Z. Thereby, the lower roller 30b is urged resiliently against the upper roller 30a, and thus against the underside of the metal sheet B. The bias of the spring 68 can be adjusted by means of a setting screw 48. Reference numeral 46 designated an eccentric lever for "opening" the application roller pair 30a,30b by a distance designated by e in FIG. 4. The rollers 30a and 30b are mounted exchangeably at the ends of shafts 28 and 67, respectively. The shaft 67 of the lower roller 30b is freewheeling and is connected with the gear 22 of a tacho-alternator 23 by means of a universal joint 31. The gear 22 is mounted on the wall part 33 by means of a trunnion screw 13 and a pin 14. By means of this arrangement of a universal joint 31, a trunnion screw 13 and a pin 14, changes in the distance between the rollers 30a and 30b are, respectively, made possible or compensated.

Due to the possibility of diametral displacement of the carrier unit 15 bearing the pair of application rollers, and to the possibility of fixing it in a desired position, it is possible to set an advance- or leading run or a follow- or tailing run, of the movement of the roller pair 30a/30b along the edge of the metal sheet B, which runs are adjusted to be optimal under the respective prevailing application conditions. During operation, the application head moves as illustrated (FIGS. 1,2 and 3) in the direction +X. When the carrier unit 15, and together therewith the application roller pair 30a/30b have been displaced in the direction −X through the position 15b indicated in phantom lines in FIG. 3, and have been fixed in this position, then this means a trailing run. The magnitude of this trailing run in the direction −X is designated by +d in the coordinate system of FIG. 2. A displacement in the opposite direction (+X) means a corresponding leading or advance run, the magnitude of which has been designated in the coordinate system of FIG. 1 by −d.

The pair of application rollers 30a,30b can, therefore, be adjusted firstly with regard to a leading or trailing movement; and secondly in the direction −Y, i.e. the direction of the roller shafts, against the bias of a spring 65; moreover, thirdly, the roller pair is rotatable, starting from a defined "Zero" position against the bias of the springs 69a and 69b, respectively, which rotation is limited by stops 62, about an axis which extends in the symnetry plane of the rollers, parallel to the Y-direction.

The tape-guiding channels 20 and 21, the conveying rollers 40a to 40c, 51a to 51c and 36a to 36c, the pre-folding rollers 16 and 17, and a counter pressure roller 18 are fastened or supported, respectively in the rotatable and displaceable casing part 15 or in the wall part 33 being solidly fastened to the former.

The conveying rollers 36a to 36c are supported in a swivel member 37 which can be swivelled about a shaft 60. Likewise, the conveying rollers 51a to 51c are supported in a swivel member 38 which can be swivelled about a shaft 59. Moreover, at its forward end, the swivel member 37 carries, displaceable in an elongated slot 18a, a counter pressure roller 18 for the first pre-folding roller 16. The swungout positions of the swivel members 37 and 38 have been indicated in FIG. 3 by phantom lines, and have been designated by 37b and 38b. In these positions, it is easy to thread in the TK-tape, to guide the adhesive film K up to the application roller pair 30a/30b and to guide the carrier tape T into the channel 20. After closing and setting the swivel members by means of the spring-supported stop lever 61, the conveying rollers are ready for operation, and the back pressure roller 18, by means of its conically shaped circumference, urges the adhesive film K into the concave or V-shaped recess of the first pre-folding roller 16. The subsequently passed second pre-folding roller 17 has a considerably smaller diameter and a smaller V-angle than the first pre-folding roller and is arranged as near as possible to the application roller pair 30*a*/30*b*. When passing over the two pre-folding rollers, the adhesive tape K is pre-folded gently and to a continuously increasing degree in the direction toward the application rollers, whereby the continuity of the folding from the application point to the conveying rollers is guaranteed. The two pre-folding rollers 16 and 17 are displaceable in the direction −Y against the bias of springs 63 and 64, respectively, whereby they can follow the metal sheet edge resiliently even when the latter is strongly curved. The constant (spring force) of the spring 63 is considerably smaller than that of the spring 65 and the constant of the spring 64 is smaller than that of the spring 63. A preferred ratio of the constants of springs 65 to 63 to 64 is about 1 to 0.3 to 0.2.

The first pre-folding roller 16 is supported in a carrier part 19 on which the spring 63 is supported and which is provided with a fork-shaped extension 19*a* which, when the swivel member 37 is being closed, engages the shaft of the back pressure roller 18, which shaft is displaceable in an elongated slot 18*a*, and guides this roller 18 automatically so that the wedge-shaped circumference of the latter enters the V-shaped circumferential groove of the pre-folding roller 17.

The pre-folding rollers 16 and 17 which are urged resiliently against the metal sheet edge, fulfill, above all, the task of urging the folding zone proper of the adhesive tape K on to the metal sheet edge, so that no hollow space is formed at that edge, and that the inner adhesive sides of the tape will not be stuck together.

The driving force for all driven rollers is supplied centrally from the motor 2 via the gear 3, bevel gears 12, a flexible shaft 11, a spur gear drive 27 and a (rigid) shaft 28 on to upper roller 30*a* of the pair of application rollers 30*a*,30*b*. A further bevel gear drive 29, driven from the shaft 28, drives a stub shaft 29*a* on which there is mounted a cog belt pulley 29*b*. The pulley 29*b* drives the conveying roller 40*b*, via a cog belt 9 and via a cog belt pulley 40*e* mounted on the elongated shaft 40*d* of the roller 40*b*. Two further cog belt pulleys 40*f* and 40*g* are mounted on the shaft 40*d* and drive the conveying rollers 40*a* and 40*c* via correspondingly devised cog belt drives (not shown). The diameter of the pulley 40*f* which drives the roller 40*c* is so dimensioned that its circumference is about 1.1 times that of the pulley 40*g*, whereby the conveying roller 40*c* runs at about 1.1 times the speed of the roller 40*a*.

At their lower or at their upper ends (i.e. outside their active lengths), the rollers 40*b*, 51*b* and 36*b* are coupled with each other by means of toothed rims being in engagement with each other. In the same manner, the rollers 40*c*,51*c* and 36*c*, on the one hand, and the rollers 40*a*,51*a* and 36*a*, on the other hand, are coupled with each other. Consequently, when the rollers 40*a*,40*b*,40*c*,36*a*,36*b* and 36*c* rotate in clockwise direction, the rollers 51*a*,51*b* and 51*c* will rotate in counterclockwise direction, the speed of the rollers 40*c*,51*c* and 36*c* being about 10% greater than that of the other rollers. The "package" of rollers is held together with tension by means of compression springs 37*a*, the longitudinal profile of the rollers being of such shape that only the roller pairs 40*b*/51*b*, 40*a*/51*a* and 51*c*/36*c* are so pressed together, over their active lengths, that they exert a conveying pressure on the TK-tape or the carrier tape T between them. The remaining rollers are profiled in axial direction, by being provided with end flanges, that a gap remains between the roller pairs 40*c*/51*c*, 51*a*/36*a* and 51*b*/36*b*, whereby these roller pairs do not have a conveying, but only a guiding function.

The roller pairs which effect the conveyance of the TK-tape and thereby of the adhesive tape K run exactly synchronously with the application rollers 30*a*,30*b*. Thus, practically no pull is exerted on the adhesive tape K between the conveying rollers and the application rollers. The removal of the carrier tape T is guaranteed with absolute safety, as the tape-removing roller pair 36*c*/51*c* runsmore rapidly and thus compensates any possible slipping of the carrier tape T. The danger of slippage occurs in practice only with the carrier tape T as the latter has a relatively smooth surface.

The pre-folding rollers 16 and 17 as well as the back pressure roller 18 are free-wheeling and thus cause practically no resistance to pull in the adhesive tape K, in contrast to the stationary pre-folding channels. It is, however, essential that the conveying rollers and pre-folding rollers follow all movements automatically in common with the application rollers, due to the common swivel member 15.

The driving speed of the (upper) roller 30*a* is controlled by the reel-off speed of the free-wheeling (lower) roller 30*b*. To this end, there are provided two commercially available electronic tacho alternators 1 and 23 which measure the reel-off speed of the roller 30*b* or the speed of the driving motor 2, respectively, and convert it into electrical control signals, from which a control signal for regulating the speed of the driving motor 2 is formed by comparison in a conventional electronic control unit 54. The control box 54 has two potentiometers with adjusting knobs 72 and 73. The potentiometer knob 72 enables regulation of the mutual speed ratio of the rollers 30*a* and 30*b* from a ratio of 1:1 to ±10% deviation. An "inherent speed" of the roller 30*a* can be adjusted, independently of the speed of the roller 30*b*, by means of the potentiometer knob 73. For instance, even at the speed "zero" of the roller 30*b*, the speed of the roller 30*a* can be adjusted to a desired base speed. This is important, in one of several situations, when, for any reason, metal sheets are to be treated that have a particularly slippery surface, and when the roller 30*b* rotates too slowly or even stands still as the application of the adhesive film K begins. The applied control enables, without connection or information exchange with the electronic control of the moving device (robot), an optimal adaptation of all roller speeds (application rollers as well as conveying rollers) to the velocity of movements of the robot inclusive of the compensation of slippage of the lower application roller 30*b*. Together with the possibilities of movement (swivelling, displacement) of the casing parts 15, 33 carrying the application rollers, conveying rollers and pre-folding rollers, this embodiment of the apparatus according to the invention thus fulfills all conditions for a uniform, warp-free application of the adhesive tape K on the sheet metal part B even at high speeds of the robot and complicated shapes of the metal sheet.

The application rollers and conveying rollers are preferably coated with silicone. The pre-folding rollers preferably consist of polytetrafluoroethylene (e.g. Teflon®). Thereby, sticking of the adhesive tape to the rollers is avoided.

In FIGS. 7 to 13 there is illustrated a further, particularly advantageous embodiment of the apparatus according to the invention.

FIG. 7 shows in perspective view and schematically the most important components of this embodiment. These comprise a pair of application rollers 101,102 and, for each of these rollers, respectively, a driving motor 103, 104 with associated tacho-alternators 105, 106, respectively, as well as a pre-folding roller 107, two conveying rollers 108 and 109, two back pressure rollers 110 and 111 and two guide rollers 112 and 113, a driving motor 114 with an associated tacho-alternator 115 for the conveying rollers, a control roller 116 mounted for swivel action, tape-guiding channels 117 and 118, serving, respectively, for the supply of the TK-tape and for the removal of the carrier tape T being separated from the adhesive film K, as well as two synthetic resin plastics hoses 119 and 120, serving, respectively, for guiding the TK-tape from a storage reel 121 into the supply channel 117, and for guiding the carrier tape T from the removing channel 118 to a suctioning-off device 122. Furthermore, an electronic circuit 123 is provided for the control of the three driving motors 103,104 and 114.

One of the main differences of this embodiment compared with the embodiment of FIGS. 1 to 6 consists in that a separate driving motor 103,104 or 114, is provided, respectively, for each of the application rollers 101 and 102, on the one hand, and for the tape conveyance, by rollers 108 and 109, on the other hand. The two motors 103 and 104, for driving application rollers 101 and 102, fed back by the tacho-alternators 105 and 106, are so controlled by the electronic circuit 123 that the application rollers 101 and 102 are, on the one hand, driven with a constant torque and, on the other hand, have a constant idling speed. Their torque and idling speed can be adjusted or preselected with the aid of two corresponding control elements 123*a* and 123*b* of the electronic circuit 123 (FIG. 13).

The conveyance of the TK-tape or of the adhesive tape K is controlled via the control roller 116. The control roller 116 is mounted on a guide arm 124 which can be swivelled about the shaft of the guide roller 113 and which is biassed by a tension spring 125, whereby the adhesive film K is always lightly tensioned. The magnitude of the basic tension can be adjusted by means of a knurled screw 126 (FIG. 13). The guide arm 124 is coupled with a potentiometer 127, whereby a swivelling of the control roller 116 causes a corresponding shift of the potentiometer 127. The potentiometer 127 is connected with the electronic circuit 123 and controls, together with the latter, the driving motor 114 for the conveyance of the tape, so that the pull in the adhesive film K always remains constant independently of the movements of the individual rollers, which will be explained hereinafter. As in the case of the first embodiment, the circumferential speed of the conveying roller 109 which pulls off the carrier tape T is always slightly greater that that of the conveying roller 108 in order to compensate any slip that may occur. The control roller 116 has preferably the configuration of a convex double cone. Thereby, there are achieved a certain deformation of the adhesive film strip K, on the one hand, and a centering of the strip, on the other hand.

Figure 13:
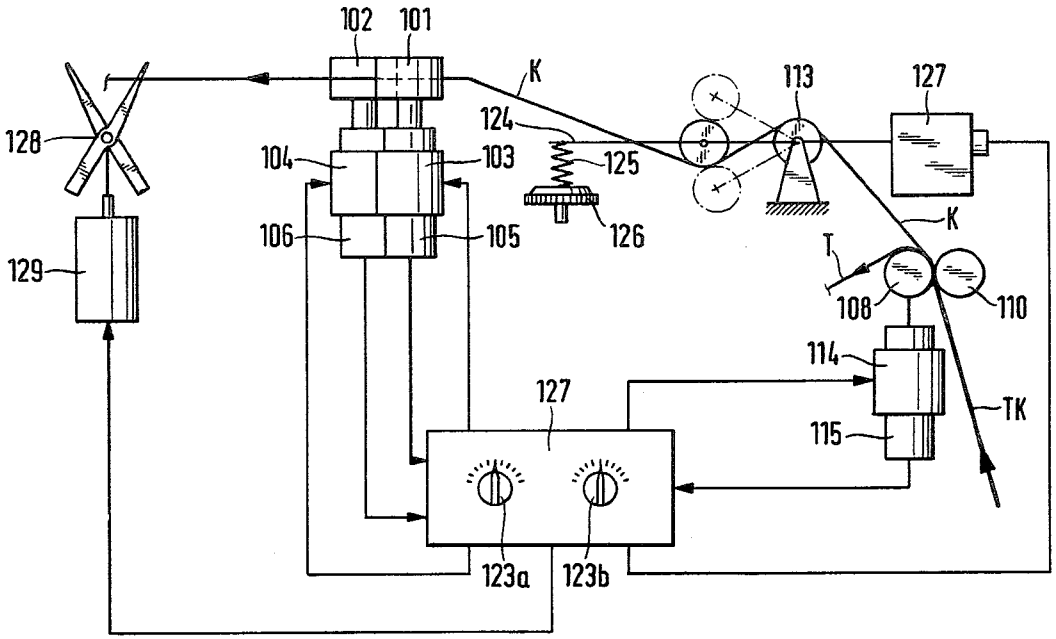
FIG. 13 is an electrical circuit block diagram.

In FIG. 13, there is always shown a cutting tool 128 which is also controlled by the electronic circuit 123 via a drive magnet 129 and serves for cutting off the adhesive film at the end of each sheet metal edge. Finally, the electronic circuit 123 is also devised for stopping abruptly the movement of the manipulating device (a robot), in cooperation with limit switches (not shown), whenever one of the possibilities of movement, to be described further below, of the diverse parts of the tape-application apparatus will exceed a certain limit set by the limit switches. It is thereby possible to avoid damaging of the application device or the sheet, or possibly of the robot, respectively.

The detailed structure of this embodiment has been illustrated in FIGS. 8 to 12. All parts of the application head proper are mounted on a bracket part 140 which is supported for resilient swivel motion about a shaft extending parallel to the X-axis in a casing 141 having an open front end. The swivel bearings have been designated by 142. The casing 141 itself is fastened to a manipulating device (robot), as in the case of the first embodiment, by means of a flange 144. A tension spring 145 is disposed between the casing 141 and the bracket part 140 and keeps the entire application head under a slight bias which is directed upwardly (+Z) and causes the lower application roller 102 to press continuously with a certain force against the metal sheet, whereby it follows the vertical movements of the sheet metal edge exactly (angle of deflection $\pm\gamma$, FIG. 10). The size of the bias can be adjusted by means of a setting screw 146.

Figure 11:
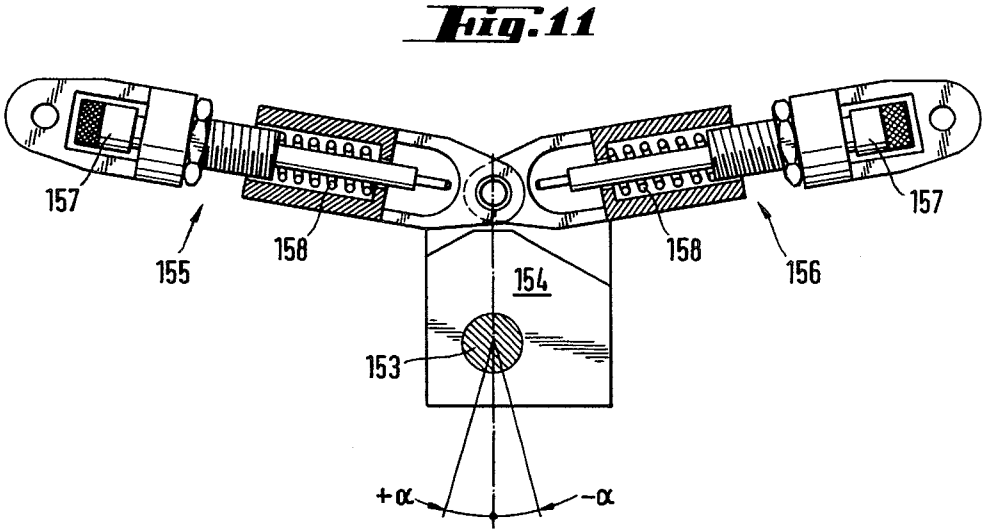
FIG. 11 is a frontal view of a detail of the second embodiment.

A stator 150 is mounted on the bracket part 140, and a cylindrical shaft 153 is supported in the stator 150 by means of ball bearings 151 and 152 and can be swivelled resiliently about the Y-axis. At the rearward stator end, the shaft 153 is connected firmly, for joint rotation, with a frontal plate 154 which is engaged by two spring struts 155 and 156 whose ends are fastened to the bracket part 140 (FIG. 11). These spring struts 155 and 156 which are each provided with a restoring cylinder spring 158 which is adjustable by means of a setting screw 157, control and limit the swivel motion (swivel angle $\pm\alpha$, FIG. 11) of the shaft 153 about a neutral position, in which the shafts of the two application rollers 101 and 102 are situated in a vertical YZ-plane.

At the forward end of the shaft 153, there is mounted, for rotation therewith, a guide plate 160, on which there is fixed a sled 161, by means of a dovetail guidance or the like. The sled 161 is adjustable in the ±X direction 161 carries all further parts of the applicator head. The displaceability of the sled in ±X direction serves for regulating the leading run or the trailing run, respectively, in analogy with that described in the first embodiment, supra.

A carrier block 162 is mounted on the sled 161. By means of guiding rods 163 which run in ball boxes 164 in the sled 161, the carrier block 162 is supported movable in a direction parallel to the axis of the shaft 153 ( in Y-direction) and is elastically held by means of springs 165 (FIG. 10). The ±Y-movement of the carrier block 162 is controlled by a support roller 166 (FIG. 9) which is rotatably borne at its forward end and the axis of rotation of which extends parallel with the Z-axis, while it rests against the edge of metal sheet B to be covered with the adhesive film and resiliently follows that edge.

In the carrier block 162 there is supported the shaft 171 of the lower application roller 102. A belt pulley 172 is mounted at the free end of the shaft 171. A belt 173 connects the application roller 102 with its associated driving motor 104 via a belt pulley 174 seated on the motor shaft (FIG. 7).

Figure 8:
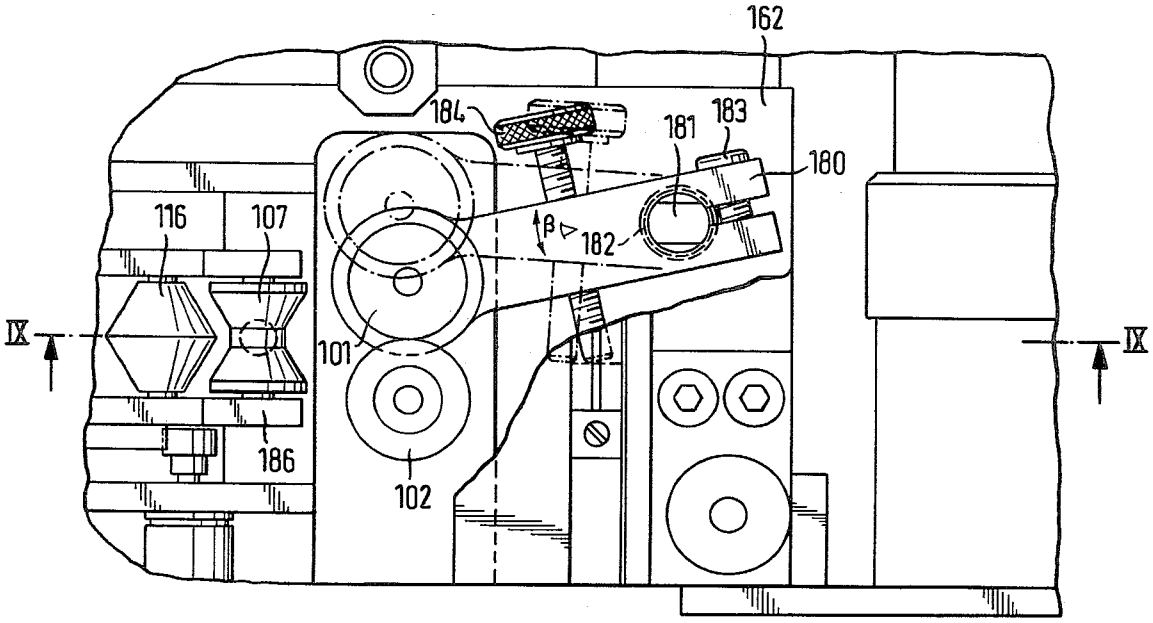
FIG. 8 is a frontal view of a portion of the application head of the second embodiment taken in the direction indicated by an arrow VIII in FIG. 9.

The shaft 175 of the upper application roller 101, which also bears a belt pulley 176 at its other end, is rotatably mounted on a swivel arm 180. The swivel arm 180 is mounted on the carrier block 162 for swivelling about a shaft 181 extending parallel with the Y-axis. A coil spring 179 urges the swivel arm 180, and together therewith the application roller 101, resiliently downwardly against the lower application roller 102, while the tension of the spring can be adjusted by means of a setting screw 183 (FIG. 8). Thus, the upper application roller 101 can carry out a vertical movement (angle $\beta$) independently of the lower roller 102. The lower stop of the swivel movement can be set by means of a setting screw 184.

The driving motor 103 for driving the upper application roller 101, which is connected with the latter via a further belt pulley 177 and a drive belt 178 (FIG. 7), is arranged in the application head in such a way that its shaft 181 registers exactly with the bearing 182 of swivel arm 180. Thus, the swivel movment of the application roller 101 has no influence on the drive connection of the latter with the motor 103.

Figure 12:
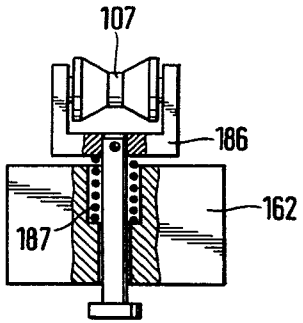
FIG. 12 is a partially sectional view of another detail of the second embodiment.

The pre-folding roller 107 is fastened freely rotatable in a bearing bracket 186 in the forward side of the carrier block 162 (FIG. 12). The bearing bracket 186 is in turn mounted displaceably in Y-direction in the carrier block 162 and is supported by means of a supporting spring 187. The pre-folding roller 107 can thus carry out independently a resilient compensating movement perpendicular to the metal sheet edge and in the plane of the metal sheet so that it can follow the metal sheet edge even through stronger curves thereof. The tension (spring constant) of the spring 187 is considerably smaller than those of the springs 165 of the sled 161.

Furthermore, there are mounted on the carrier block 162 the guide roller 113 and the control roller 116 as well as the potentiometer 127 (not visible). The other parts of the tape conveyance system, i.e. the two conveying rollers 108 and 109, the two back pressure rollers 110 and 111 and the guide roller 112 are located on a carrying bracket 168 connected by a flange thereof with the sled 161. The two conveying rollers 108 and 109 are connected by means of shafts (not shown) with belt pulleys 190 and 191 (FIG. 10) which are coupled with the driving motor 114 (FIG. 7) via a drive belt 192 and a belt pulley 193 (FIG. 9) mounted on the shaft of the motor. On the carrying bracket 168 there are also mounted the two tape guiding channels 117 and 118. The two back pressure rollers 110 and 111 are arranged for swivelling about the guide roller 112 and can be arrested in the open position by means of a latch 195, in order to enable introduction of the TK-tape or removal of the carrier tape T. In operational position, the back pressure rollers are urged each by means of a spring 196 or 197, respectively, against the conveying rollers 108 and 109, while the tension of the spring 197 can be adjusted by means of a setting screw 198.

In the second embodiment described hereinbefore, the application roller pair 101/102 thus offers, together with the pre-folding roller 107, four possibilities of elastically supported movements. These are a vertical rocking movement of the entire head about the axis of the swivel bearing 142, the rotation about the axis of the cylindrical shaft 153, a transverse movement in the direction $\pm X$ for adjusting leading and trailing runs, and a stroke parallel with the cylindrical shaft 153 in the direction $\pm Y$. Additionally, the upper application roller 101 can be moved perpendicularly, relative to the lower roller 102, and the pre-folding roller 107 can be moved in Y-direction relative to the application rollers. All of these possibilities of movement afford a warp-free and uniform application of the adhesive film K on the metal sheet B even at high speeds and with complicated geometries of the sheet edge. The electronically controlled drive of the two application rollers 101 and 102 and of the conveying means of the tape via separate driving motors affords, without connections or information exchange with the control electronics of the manipulating device (robot) an optimal adaptation of all roller speeds to the velocity of movement of the robot inclusive of compensation of any slippage The three possibilities of spring supported movements (rocking, rotation and stroke) guarantee that the two application rollers will follow the metal sheet edge optimally under all conditions.

What is claimed is:

1. An apparatus for the application of an adhesive tape, longitudinally and with U-shaped cross section, about the edge of a shaped part of sheet metal, which apparatus is provided with tape-guiding means, comprising conveying rollers, and means for pre-folding the adhesive tape from which the pre-folded tape runs between a pair of application rollers spring-biassed against each other and being adapted to press the tape simultaneously on to both sides of said shaped sheet metal part being introduced into the tape-folding zone, said pair of application rollers and said means for pre-folding the adhesive tape being adapted for being swivelled, against the restoring bias of a spring, about a common swivel axis extending parallel with the axes of said application rollers.

2. The apparatus of claim 1, wherein said pair of application rollers is mounted adjustably about said common swivel axis.

3. The apparatus of claim 2, wherein said pair of application rollers is arranged, relative to the direction of movement of the shaped sheet metal part, behind said swivel axis.

4. The apparatus of claim 1, wherein said pair of application rollers and said means for pre-folding the adhesive tape are adapted to be shifted together rearwardly and parallel with said common swivel axis against the bias of a compression spring.

5. The apparatus of claim 2, wherein said pair of application rollers and said means for pre-folding the adhesive tape are mounted in an adjustable carrier unit which is displaceably transverse to said common swivel axis as well as fixably mounted on a rotatable support unit being rotatable about said common swivel axis.

6. The apparatus of claim 5, wherein said means for pre-folding the adhesive tape are adapted to be displaced relative to said rollers and parrallely to their axes against the bias of a displacement cushioning spring.

7. The apparatus of claim 1, wherein said pair of application rollers and said pre-folding means are adapted to be suspended together for elastically swivelling about a tilting axis which is perpendicular to the plane defined by the axes of said pair of application rollers.

8. The apparatus of claim 1, wherein one of said two application rollers of said pair is arranged to be swivelled about an axis which extends in parallel with the axis of rotation of that same roller, and is supported to press with bias against the other application roller.

9. The apparatus of claim 1, wherein each of the two application rollers of said pair is driven by a separate driving motor having an adjustable constant torque.

10. The apparatus of claim 9, wherein an electronic circuit is provided for controlling said driving motors, by means of which circuit the torque and the idling speed of said motors, or, respectively, of the application rollers driven by them, can be adjusted.

11. The apparatus of claim 8, wherein said conveying rollers are driven by a separate driving motor which is controlled by the one and same electronic circuit, while the adhesive tape is conveyed via a control roller prior to reaching said pre-folding means.

12. The apparatus of claim 11, wherein said control is supported pivotably about an axis which is parallel with the axis of said control roller against the bias of a restoring spring, while the deflection of the control roller depends on the tractive force of the adhesive tape.

13. The apparatus of claim 12, wherein said control roller is coupled with an electric measuring transducer which, in cooperation with said electronic circuit, so controls the driving motor for the conveying rollers that the tensile stress in the adhesive tape remains constant.

14. The apparatus of claim 1, wherein said pair of application rollers and said pre-folding means are mounted in a supporting block which is carried by a carriage or sled and elastically movable in the direction of the common swivel axis.

15. The apparatus of claim 14, wherein said sled is mounted transversely adjustably on a guiding plate, serving as carrier element and being resiliently pivotable about said common swivel axis.

16. The apparatus of claim 15, wherein said guiding plate is supported for swivelling in a bracket part which is in turn mounted resiliently tiltable in a casing.

17. The apparatus of claim 5, wherein said supporting unit is rotatable about said common swivel axis and is displaceable toward the rear in the direction of said common swivel axis against the bias of a compression spring.

18. The apparatus of claim 17, wherein said rotatable support unit is a hollow body which can be rotated as well as swivelled and which is mounted for displacement against the force of said compression spring, whereby said common swivel axis constitutes the central axis of said hollow body.

19. The apparatus according to claim 1, wherein said means for pre-folding the adhesive tape is a roller of concave cross section.

20. The apparatus according to claim 1, wherein said means for pre-folding the adhesive tape is a roller of V-shaped cross section.

21. The apparatus of claim 1, wherein said conveying rollers are urged in pairs resiliently against one another, at least one roller of each pair being supported on a swivel member adapted to be swung out, such swivel members being opened for threading into them an adhesive-cum-carrier tape or a base carrier tape, and being closed in conveyance-activating position by means of a spring biassed stop lever.

22. The apparatus of claim 1, wherein a tape-guiding channel can be provided ahead of said conveying rollers, in the direction of tape movement, which channel has a cross sectional area of such configuration as to secure the tape against twisting and which is so curved away from longitudinal direction that the tape can contact the rollers of the conveying roller train with always only one and the same carrier tape side.

23. The apparatus of claim 9, wherein one of the two application rollers is a free wheeling roller which is connected with a first electronic tacho-generator whose output signal is used for controlling the driving motor of the other roller.

24. The apparatus of claim 23, wherein said last-mentioned driving motor is connected to a second tacho-generator, and the control of said last-mentioned driving motor is effected by means of an electronic circuit which produces a control signal for said last-mentioned motor by comparison of the output signals of the first and second tacho-generators.

* * * * *